US006541722B1

(12) United States Patent
Whipple et al.

(10) Patent No.: US 6,541,722 B1
(45) Date of Patent: Apr. 1, 2003

(54) FINGER BARRIER FOR ELECTRIC POWER SWITCHES AND ELECTRIC POWER SWITCH INCORPORATING THE SAME

(75) Inventors: Michael Jerome Whipple, Rochester, PA (US); Edward Ethber Lias, Aliquippa, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/000,189

(22) Filed: Oct. 19, 2001

(51) Int. Cl.[7] ..... H01H 9/06
(52) U.S. Cl. ..... 200/293; 200/304
(58) Field of Search ..... 200/293, 304–307, 200/303, 296, 333–334, 294; 335/202, 8

(56) References Cited

U.S. PATENT DOCUMENTS 4,697,860 A 10/1987 Hildebrandt et al.
5,150,091 A 9/1992 Hart et al.
5,304,761 A 4/1994 Rosen et al.
5,486,666 A * 1/1996 Wong et al. ..... 200/304
5,488,337 A 1/1996 Hubbard et al.
5,831,498 A 11/1998 Maloney et al.
6,144,001 A 11/2000 Green et al.
6,172,586 B1 * 1/2001 Ferree et al. ..... 335/202

FOREIGN PATENT DOCUMENTS

JP 02126529 A 5/1990

* cited by examiner

*Primary Examiner*—Elvin Enad
*Assistant Examiner*—M. Fishman
(74) *Attorney, Agent, or Firm*—Martin J. Moran

(57) ABSTRACT

A monolithic finger barrier for blocking insertion of a human finger into the open end of a terminal recess in the molded casing of an electric power switch such as a circuit breaker includes a planar member that slides into mountings slots in the switch casing traverse to the open end of the terminal recess and has integral resilient fingers extending along one face adjacent side edges of the planar member. Laterally, outwardly extending catches on the resilient fingers, which engage catch surfaces in the casing, can only be released to remove the barrier when the planar member is installed with the one face facing away from the terminal recess so that integral grips on the fingers are accessible.

13 Claims, 2 Drawing Sheets

FINGER BARRIER FOR ELECTRIC POWER SWITCHES AND ELECTRIC POWER SWITCH INCORPORATING THE SAME

BACKGROUND OF THE INVENTION

1. Field of the Invention

This invention relates to electric power switches and to finger barriers for preventing contact with energized components within terminal recesses in the molded casings of such switches.

2. Background Information

In some instances, protection has been provided against finger contact with the terminals of circuit breakers commonly used in residential and light commercial applications, also known as miniature circuit breakers, through configuration of the molded casing. Thus, separate molded parts are needed to provide the circuit breaker with finger protection, requiring the manufacturer to make and stock two models of each breaker to satisfy both those customers that want that feature and those that do not. Also, the users must choose whether or not to purchase a breaker with that feature and cannot later eliminate or add the feature without purchasing a new breaker.

There is room for improvement therefore, in finger protection for electric power switches such as circuit breakers, and in particular, miniature circuit breakers.

SUMMARY OF THE INVENTION

The present invention allows a user to selectively apply finger protection to an electric power switch such as a circuit breaker. As another aspect of the invention, the user can install finger protection for easy removal or for permanent installation. At the same time, the manufacturer need only make and stock a single model of the circuit breaker as the finger barrier is a separate item that can be purchased and installed by the user.

More particularly, the invention is directed to a finger barrier for an electric power switch having a molded casing with an open ended terminal recess and transverse mounting slots adjacent each side of the open end of the recess. The finger barrier comprises a planar member having side edges sized to be slideably received in the mounting slots to cover the open end of the external terminal recess. The finger barrier further includes at least one integral locking finger extending along one face of the planar member adjacent one of the side edges. This locking finger is fixed only at a fixed end to the planar member and has a free end that is laterally, resiliently deflectable. A laterally outwardly extending catch on the free end of the locking finger engages a locking ledge associated with the mounting slots. Preferably, the planar member has two of the integral locking fingers, each extending along the one face of the planar member adjacent one of the side edges with each of these locking fingers having a laterally outwardly extending catch which can engage the catch surface in the molded casing. The locking fingers have releases adjacent the free ends which can be actuated to release the latches for removal of the finger barrier from the mounting slots in the molded casing of the switch.

In order to provide the user with the ability to easily remove the barrier or to have the barrier permanently installed, the planar member is insertable in the mounting slots in a first orientation in which the first face, and therefore the locking fingers also, face the terminal recess, and a second orientation in which the other face of the planar member faces the terminal recess. The releases have engagement surfaces which are not accessible when the planar member is inserted in the first orientation so that the planar member cannot be easily removed. However, when the planar member is inserted in the second orientation so that the releases on the locking fingers face outward and are easily accessible, the finger barrier can easily be removed. Preferably, the releases are finger grips which can be squeezed together to disengage the catches from the catch surfaces associated with the mounting slots.

The planar member can have cutouts extending along the side edges, and the locking fingers, except for the fixed ends which are integrally formed with the planar member, register with these cutouts. This provides a finger barrier with no undercuts so that it can be molded in a straight draw mold without the need for slides or other movable mold parts.

The invention also extends to an electric power switch equipped with such a finger barrier.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
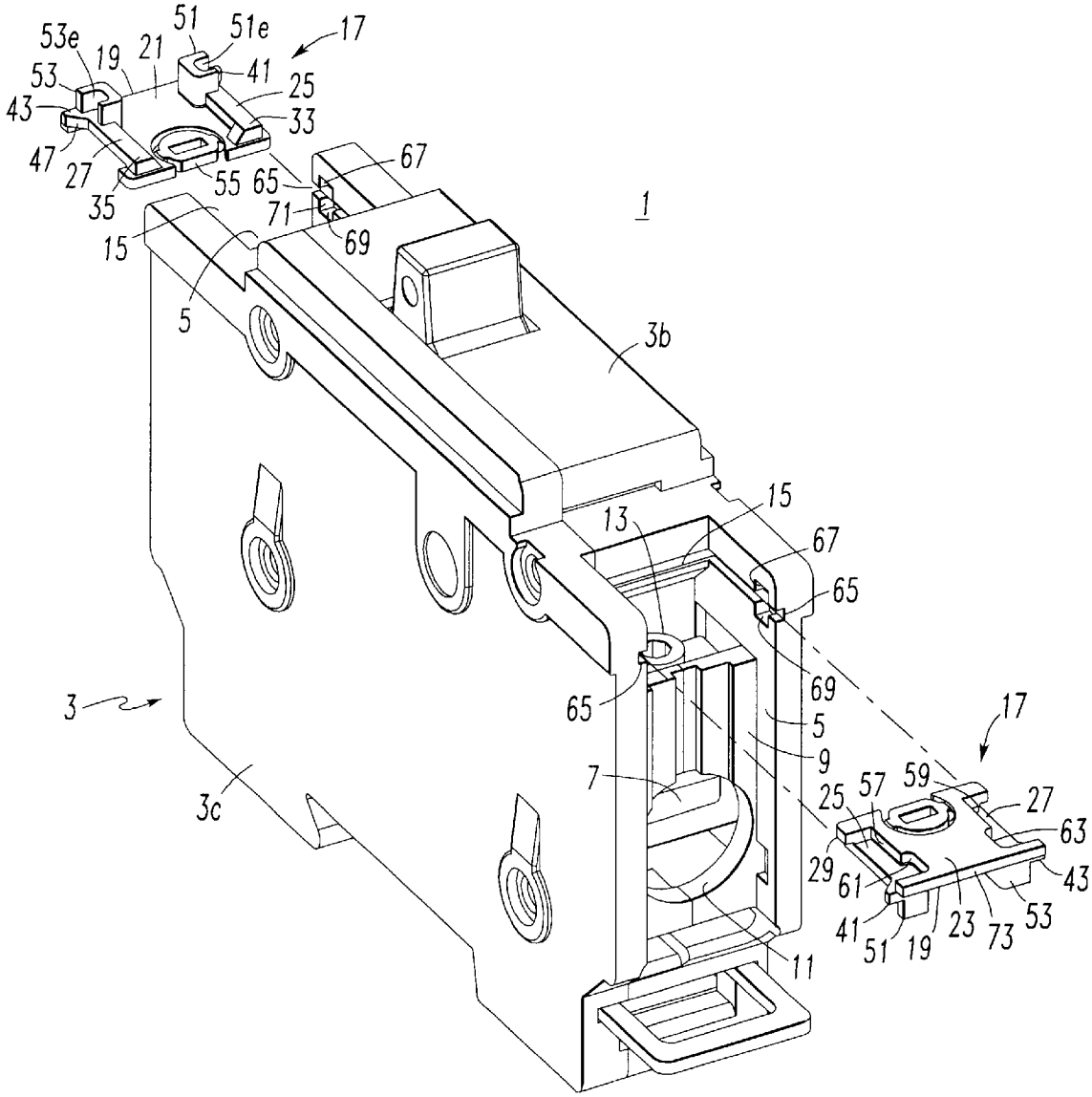
FIG. 1 is an exploded isometric view of a miniature circuit breaker together with two finger barriers in accordance with the invention, with the one on the right orientated for permanent installation with the circuit breaker and the one on the left orientated for removable mounting on the circuit breaker.

The invention will be described as applied to a miniature circuit breaker, however, it will become evident that it has application to other electric power switches, including other circuit breakers.

As shown in the Figures, the miniature circuit breaker 1 has a molded casing 3 formed of two parts, a base 3*b* and a cover 3*c*. At each end of the molded casing 3 is an external terminal recess 5 which is open at the top. Main conductors 7 of the circuit breaker extend into the open ended terminal recesses 5. Each terminal recess 5 has a front wall 9 with an opening 11 through which an electrical lead (not shown) in a power distribution system (not shown) to be protected is inserted for connection to the main conductor 7, typically by a collar terminal 13.

It can be appreciated that the collar terminal 13 which becomes electrically energized, could be contacted by a human finger inserted through the open end 15 of the terminal recess.

In order to selectively close off the opening 15, a finger barrier 17 is provided. This finger barrier has a planar member 19 with a first face 21 and a second face 23. At least one and preferably two locking fingers 25 and 27 are integrally molded with the planar member and extend along, such as in a plane generally parallel to, the first face 21 of the planar member adjacent the side edges 29 and 31, respectively. Thus, the locking fingers 25 and 27 have fixed ends, 33 and 35, respectively, and free ends 37 and 39, which are resiliently laterally flexible. Integral catches 41, 43 extend laterally outwardly from the free ends 37, 39 of the locking fingers 25, 27, respectively. These catches each have a chamfered leading edge 45, 47.

The finger barrier 17 further includes a release 49 in the form of a pair of finger grips 51 and 53 integrally molded on the free ends 37 and 39 of the locking fingers. These finger grips 51, 53 have engagement surfaces 51*e*, 53*e* by which they may be gripped and squeezed together to thereby draw the catches 41 and 43 inward through flexure of the locking fingers 25 and 27.

In order to provide a restricted opening for insertion of a tool such as a screwdriver to engage the collar terminal while still blocking insertion of a finger, the planar member 19 is provided with a knockout 55 which can be selectively removed, in a well know manner, by the user.

Figure 3:
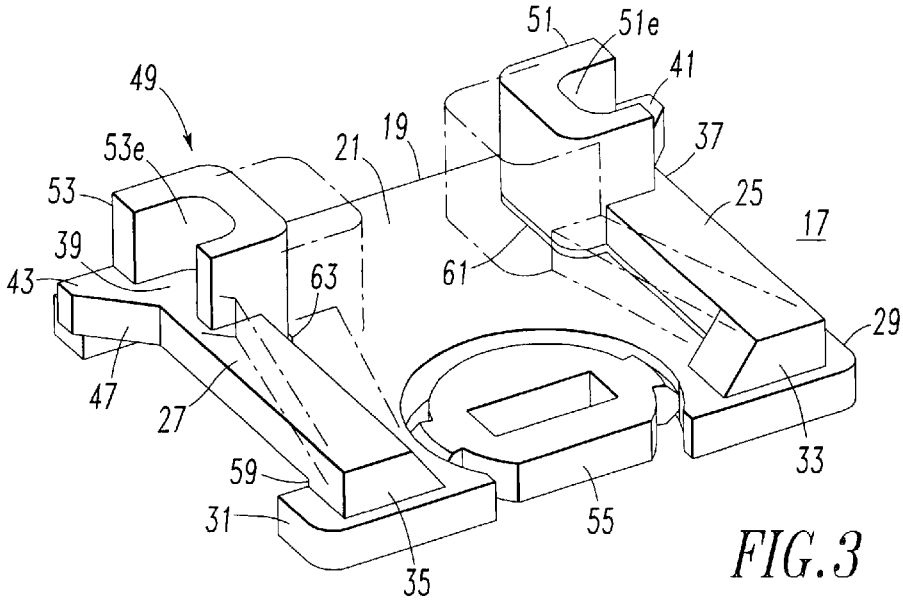
FIG. 3 is an isometric view of a finger barrier in accordance with the invention illustrating deflection of the finger grips in phantom.

The finger barrier 17 is molded as a single piece from a suitable electrically insulative resin. Such a material provides a sturdy barrier, yet has the flexibility to allow the locking fingers 25, 27 to be resiliently deflected. In the relaxed state as shown in FIG. 3 in solid line, the catches 41, 43 extend laterally outward beyond the side edges 29, 31 of the planar member 19. In order to simplify, and reduce the cost of molding the finger barrier 17, the side edges 29 and 31 of the planar member are provided with cutouts 57, 59 with which the locking fingers 25, 27 register, except for the fixed ends 33, 35 where they are integral with the planar member 19. In addition, the cutouts 57, 59 have extensions 61, 63 which accommodate the finger grips 51, 53. This arrangement allows the finger barriers 17 to be molded in a straight draw mold without the need for slides or other movable parts.

The molded casing 3 is formed with a pair of mounting slots 65 which extend transversely to the terminal recess 5 adjacent the open end 15. The side edges 29 and 31 of the planar member 19 are sized to slide in these mounting slots 65. Molded into the casing 3 above and below each of the mounting slots 65 are pockets 67 and 69, which form at their forward walls a catch surface 71.

The monolithic finger barrier 17 can be installed in the mounting slots 65 to block insertion of a human finger into a terminal recess 5 in two orientations. In the first orientation illustrated by the barrier 17 at the right end of FIGS. 1 and 2, the side edges 29, 31 of the planar member 19 are inserted in the slots 65 with the first face 21 facing downward toward the open end 15 of the terminal recess 5 and with the second face 23 up. The chamfered leading edges 45, 47 on the catches 41, 43 are engaged by the roots of the slots 65 to squeeze the locking fingers 25, 27 laterally inward until the catches are aligned with the lower pockets 69, whereupon the locking fingers 25, 27 spring outward so that the catches engage the catch surfaces 73 to retain the finger barrier in place. When the finger barrier is installed in this first orientation, the finger grips 51 and 53 are facing downward so that the engagement surfaces 51*e*, 53*e* are not accessible for releasing the barrier. It be noted that the locking fingers 25 and 27 extend toward the trailing edge 73 of the planar member 19 and that the ends of the finger grips 51 and 53, while visible, provide no engagement surface by which they may be gripped and squeezed together to release the catches.

Figure 2:
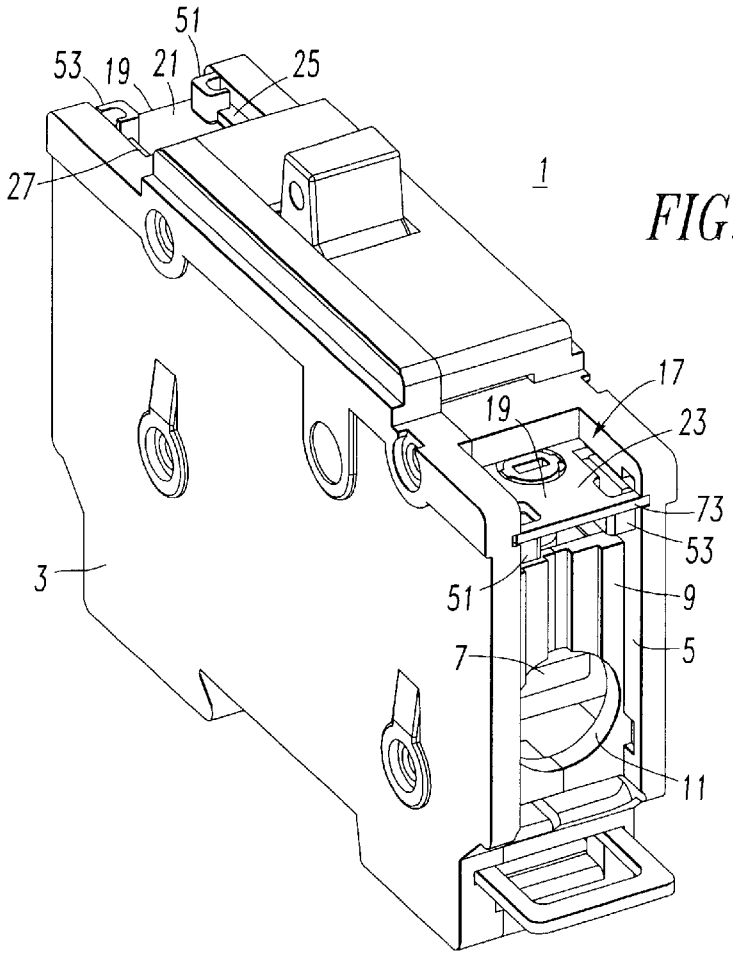
FIG. 2 is an isometric view similar to that of FIG. 1, but with the two finger grips mounted on the circuit breaker.

In the second orientation of the finger barrier which is illustrated by the barrier 17 on the left end of FIGS. 1 and 2, the first surface 21 of the planar member faces upward and the second surface 23 faces the opening 15 in the terminal recess 5. In this arrangement when the side edges 29, 31 of the planar member 19 are inserted in the mounting slots 65, the finger grips 51 and 53 face upward. Again, as the planar member is fully inserted, the catches 41, 43 are squeezed inward by the chamfered edges 45, 47, but then spring outward to enter the upper pockets 67 for engagement with the catch surfaces 71. In this second orientation, if it is desired to remove the finger barrier 17, the engagement surfaces 51*e*, 53*e* on the finger grips 51, 53 are readily accessible so that the free ends of the locking fingers can be squeezed together to disengage the catches.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A finger barrier for an electric power switch having a molded casing with a terminal recess with an open end and transverse mounting slots adjacent each side of the open end, and with at least one of the mounting slots having an associated catch surface, said finger barrier comprising: a planar member having side edges sized to be slideably received in the mounting slots to cover the open end of the open ended terminal recess, and at least one integral locking finger extending along and in a plane substantially parallel to a first face of the planar member adjacent one of the side edges and fixed only at a fixed end to the planar member while having a laterally resiliently deflectable free end with a laterally outwardly extending catch which engages the catch surface.

2. The finger barrier of claim 1 in which the transverse mounting slots in the molded casing each have an associated catch surface and wherein the planar member has two integral locking fingers each extending along the one face of the planar member adjacent one of the side edges and each having a laterally resiliently deflectable free end with a laterally outwardly extending catch which engages one of the catch surfaces.

3. The finger barrier of claim 2 wherein the integral locking fingers extend in a plane generally parallel to the planar member and the catches extend laterally outward beyond the side edges of the planar member with the locking fingers in a relaxed state, the locking fingers having releases adjacent the free ends which are accessible from the first face of the planar member to deflect the free ends of the locking fingers inward to release the catches from the catch surfaces so that the planar member is slideable out of the mounting slots.

4. The finger barrier of claim 3 wherein the locking fingers extend toward a trailing edge of the planar member as the planar member is inserted in the mounting slots and the releases are comprised of a finger grip on each of the locking fingers which have no gripping edges facing the trailing edge.

5. The finger barrier of claim 3 wherein the planar member is insertable in the mounting slots in a first orientation with the one face facing the open end of the open ended terminal recess and alternatively, in a second orientation with a second face of the planar member facing the open end of the open ended terminal recess and wherein the releases are only accessible to deflect the locking fingers inward to disengage the catches for removal of the planar member from the mounting slots with the planar member inserted in the mounting slots in the second orientation.

6. The finger barrier of claim 2 wherein the planar member has cutouts along the side edges with which the locking fingers, except for the fixed ends integral with the planar member, register.

7. The finger barrier of claim 6 wherein the locking fingers have finger grips squeezeable inward to deflect the free ends of the locking fingers and release the catches from the catch surfaces for removal of the planar member, the finger grips extending laterally inward from the free ends of the locking fingers and the cutouts along the side edges of the planar member having lateral extensions with which the finger grips register.

8. The finger barrier of claim 1 wherein the planar member has a knockout which can be removed to provide tool access to the open ended terminal recess with the planar member inserted in the mounting slots.

9. An electric power switch comprising:

a molded casing having an external terminal recess with an open end, transverse mounting slots adjacent each side of the open end of the external terminal recess, and catch surfaces above and below each mounting slot;

a terminal in the external terminal recess; and a finger barrier for the external terminal recess comprising:

a planar member having side edges sized to slide in the mounting slots and a pair integral locking fingers extending in a plane substantially parallel to a first face of the planar member, each of the locking fingers being adjacent a side edge of the planar member and each of the locking fingers having a laterally outwardly extending catch which engages one of the catch surfaces to latch the planar member in the mounting slots covering the open end of the external terminal recess, the planar member being insertable in the mounting slots in a first orientation with the first face and therefore the locking fingers facing the open end of the external terminal recess and a second orientation with a second face of the planar member facing the open end of the external terminal recess, the locking fingers having releases for disengaging the catches from the catch surfaces, the releases having engagement surfaces which are accessible only with the planar member inserted in the mounting slots in the second orientation.

10. The electric power switch of claim 9 wherein the locking fingers extend toward a trailing edge of the planar member as the planar member is inserted in the mounting slots and wherein the releases comprise finger grips integrally formed with the locking fingers and providing the engagement surfaces which are not accessible from the trailing edge of the planar member.

11. The electric power switch of claim 9 wherein the planar member of the finger barrier has cutouts along the side edges with which the locking fingers register except where integrally connected to the planar member.

12. The electric power switch of claim 9 wherein the catches have chamfered leading edges which deflect the locking fingers inward until the catches engage the catch surfaces and the locking fingers spring outward to maintain the catches in engagement with the catch surfaces.

13. The electric power switch of claim 9 wherein the planar member has a knockout which when removed provides restricted access to the external terminal recess with the planar member inserted in the mounting slots.

* * * * *